US005324397A

United States Patent [19]

Wu

[11] Patent Number: 5,324,397

[45] Date of Patent: Jun. 28, 1994

[54] METHOD FOR INHIBITING CORROSION OF CARBON STEEL IN CONTACT WITH HYDROFLUORIC ACID AND TETRAHYDROTHIOPHENE-1, 1-DIOXIDE

[75] Inventor: Yiing-Mei Wu, Sewell, N.J.

[73] Assignee: Mobil Oil Corporation, Fairfax, Va.

[21] Appl. No.: 910,797

[22] Filed: Jul. 9, 1992

[51] Int. Cl.[5] ..... C23F 13/00

[52] U.S. Cl. ..... 204/147; 204/148; 204/196; 204/197

[58] Field of Search ..... 204/147, 148, 196, 197

[56] References Cited

U.S. PATENT DOCUMENTS

| | | | |
|---|---|---|---|
| 2,615,908 | 10/1952 | McCaulay et al. | 260/438 |
| 3,208,925 | 9/1965 | Hutchison et al. | 204/196 |
| 3,249,524 | 5/1966 | Sheldahl | 204/148 |
| 3,461,051 | 8/1969 | Vrable | 204/196 |
| 3,531,546 | 9/1970 | Hervert | 260/683.51 |
| 3,778,489 | 12/1973 | Parker et al. | 260/683.43 |
| 3,795,712 | 3/1974 | Torck et al. | 260/671 |
| 3,856,764 | 12/1974 | Throckmorton et al. | 260/82.1 |
| 4,636,488 | 1/1987 | Imai et al. | 502/172 |
| 4,938,935 | 7/1990 | Audeh et al. | 423/240 |
| 4,938,936 | 7/1990 | Yan | 423/240 |
| 4,985,220 | 1/1991 | Audeh et al. | 423/240 |

OTHER PUBLICATIONS

Murphy et al., *Foundations of College Chemistry*, 2d.ed., (1975), p. 90.

1 Handbook of Petroleum Refining Processes 23–28 (R. A. Meyers, ed., 1986).

*Primary Examiner*—T. Tung

*Attorney, Agent, or Firm*—Alexander J. McKillop; Dennis P. Santini; Robert B. Furr, Jr.

[57] ABSTRACT

A method for inhibiting corrosion of carbon steel in contact with a mixture of hydrofluoric acid and tetrahydrothiophene-1,1-dioxide comprising raising the electrical potential of said structure such that the electrical potential of said structure is positive with respect to said solution containing hydrofluoric acid and tetrahydrothiophene-1,1-dioxide.

15 Claims, 1 Drawing Sheet

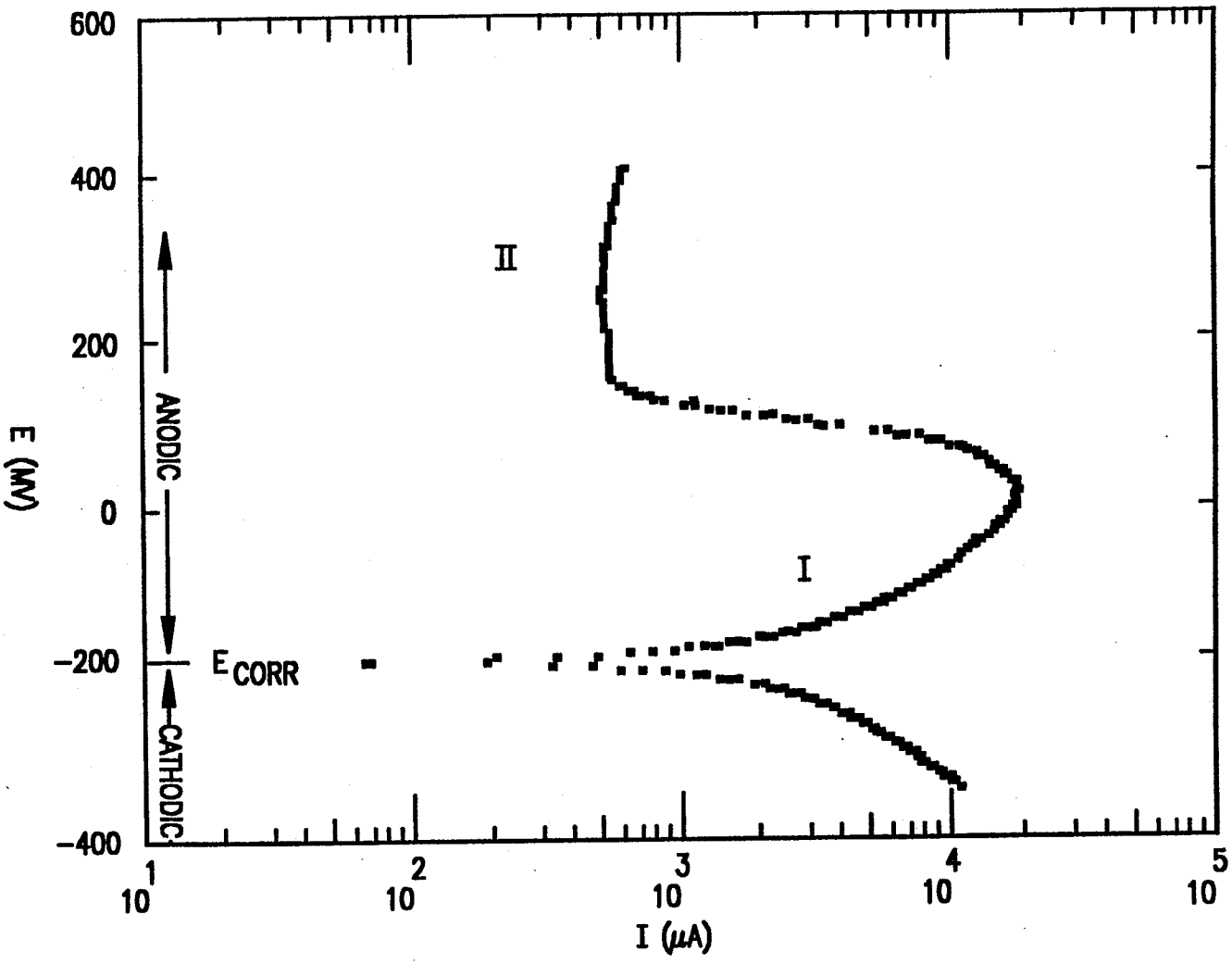
FIGURE

METHOD FOR INHIBITING CORROSION OF CARBON STEEL IN CONTACT WITH HYDROFLUORIC ACID AND TETRAHYDROTHIOPHENE-1, 1-DIOXIDE

FIELD OF THE INVENTION

This invention relates to the art of corrosion control. More particularly, this invention provides methods for inhibiting the corrosion of carbon steel in contact with hydrofluoric acid and tetrahydrothiophene-1,1-dioxide.

BACKGROUND OF THE INVENTION

Hydrofluoric acid is useful in such diverse fields as isoparaffin-olefin alkylation, fluorination, semiconductor manufacture, steroid synthesis, tantalum recovery, and xylene separation.

Industrial isoparaffin-olefin alkylation processes have historically used concentrated hydrofluoric acid catalysts under relatively low temperature conditions. The acid strength is preferably maintained at 88 to 94 weight percent by the continuous addition of fresh acid and the continuous withdrawal of spent acid. As used herein, the term "concentrated hydrofluoric acid" refers to an essentially anhydrous liquid containing at least about 85 weight percent HF.

Alkylation is a reaction in which an alkyl group is added to an organic molecule. Thus an isoparaffin can be reacted with an olefin to provide an isoparaffin of higher molecular weight. Industrially, the concept depends on the reaction of a $C_2$ to $C_5$ olefin with isobutane in the presence of an acidic catalyst producing a so-called alkylate. This alkylate is a valuable blending component in the manufacture of gasolines due not only to its high octane rating but also to its sensitivity to octane-enhancing additives. For a survey of hydrofluoric acid catalyzed alkylation, see 1 *Handbook of Petroleum Refining Processes* 23–28 (R. A. Meyers, ed., 1986).

Recently, more stringent environmental regulations have prompted a new look at methods of storing and processing hydrofluoric acid. Specifically, researchers have investigated possible solvents which could be used to dilute the hydrofluoric acid (thus rendering it safer) while preserving its commercial useful characteristics. Tetrahydrothiophene-1,1,-dioxide (also referred to herein as sulfolane) has been found to be a useful additive for hydrofluoric acid in isoparaffin-olefin alkylation.

Dilute solutions of water and hydrofluoric acid are highly corrosive toward carbon steel. Neat hydrofluoric acid is essentially noncorrosive toward carbon steel, and it is industry practice to handle and store neat hydrofluoric acid using carbon steel equipment. Neat tetrahydrothiophene-1,1-dioxide (sulfolane) is similarly relatively noncorrosive toward carbon steel. Surprisingly, mixtures of hydrofluoric acid and tetrahydrothiophene-1,1-dioxide are highly corrosive. Carbon steel process equipment would have a projected useful life of no more than a few months in the presence of mixtures of hydrofluoric acid and tetrahydrothiophene-1,1-dioxide.

Carbon steel typically loses mass (corrodes) when it is the anode in a galvanic cell. But if the carbon steel is connected to an appropriate anode, the carbon steel becomes the cathode, and the anode corrodes (is sacrificed) to preserve the carbon steel. For example, residential water heaters often contain sacrificial zinc anodes which are electrically coupled to the vessel shell.

The zinc is referred to as the sacrificial anode because, in its role as the anode of a galvanic cell, the zinc loses mass in the corrosion reaction and is sacrificed to save the carbon steel.

Carbon steel above-ground storage tanks can contain sacrificial anodes which are buried in the ground just below the tank floor. The sacrificial anode, which is typically zinc or magnesium, is electrically connected to the tank floor by a cable to prevent corrosion damage to the tank.

Other materials of construction, in contrast, become more resistant to corrosion when they become the anode of a galvanic cell. Impressed current, or anodic protection, prevents long-term damage to certain austenitic stainless steels in contact with sulfuric acid. These austenitic stainless alloys corrode to a point, and then appear to form a tenacious protective film which prevents further attack.

It is generally accepted in the industry that raising the potential of a carbon steel structure (making it more anodic) with respect to a corrosive solution accelerates corrosive attack.

SUMMARY OF THE INVENTION

Now it has been discovered that anodic protection is an effective corrosion control method for carbon steel in contact with solutions containing hydrofluoric acid and tetrahydrothiophene-1,1-dioxide. That the method works at all is indeed surprising because it is well accepted among those skilled in the art of corrosion control that anodic protection is not an acceptable method for controlling carbon steel corrosion in known systems.

The present invention provides a method for inhibiting corrosion of carbon steel in contact with a mixture of hydrofluoric acid and tetrahydrothiophene-1,1-dioxide comprising raising the electrical potential of said structure such that the electrical potential of said structure is positive with respect to said solution containing hydrofluoric acid and tetrahydrothiophene-1,1-dioxide.

BRIEF DESCRIPTION OF THE DRAWING

The FIGURE shows the results of a polarization scan with respect to the $Cu/CuF_2$ reference electrode. The scan rate was 0.5 mV/sec.

DETAILED DESCRIPTION

HF is used as a catalyst in commercial alkylation processes. The corrosion rates of common metals, such as iron, copper and nickel, are low in anhydrous HF liquid. N. Hackerman, E. S. Snavely, Jr., and L. D. Fiel, Corros. Sci. Vol. 7, 39 (1967).

Because of increasingly stringent environmental regulations, HF/sulfolane has been tested as an alternative to HF in alkylation. The corrosion problem is greatly exacerbated by the addition of sulfolane to HF.

The present invention provides an effective corrosion inhibition method, anodic protection, which reduces the corrosion rate of carbon steels in HF/sulfolane systems. While not to limit the scope of the invention by a recitation of theory, data suggest that the carbon steel forms a compact and protective film in the anodic reaction zone. This is surprising and not in accordance with the known behavior of carbon steel in other corrosive solutions.

By reducing corrosion rate, the invention makes HF/sulfolane mixtures commercially viable replacements for neat or concentrated HF in an existing alkylation process unit. The invention not only reduces the cost of operating a commercial HF alkylation process unit but also makes the unit safer. Further, by decreasing the both the fuming tendency of the stored HF, as well as the likelihood that this mixture might be released, the invention renders HF alkylation a more environmentally acceptable option.

When a metal is exposed to a corrosive solution, the natural potential the metal takes on is called the corrosion potential ($E_{corr}$). The application of anodic (positive) current or potential to a structure should tend to increase the dissolution rate of the metal and decrease the rate of reduction reaction, such as hydrogen evolution. But applying a positive potential to a carbon steel structure is well known in the industry to be a good way to increase the corrosion rate.

The present invention contemplates protecting carbon steel structures in HF/sulfolane solutions in a number of different ways. One method to anodically protect carbon steel structures in HF/sulfolane solutions is to electrically connect the carbon steel structure to a potentiostat which maintains the carbon steel at a (higher) constant potential with respect to a reference electrode. Another method of applying the anodic protection method of the invention is to connect the carbon steel to a more noble metal, i.e., a metal that has higher oxidation potential than carbon steel in HF/sulfolane, such as Monel. ($E_{corr}=-0.195$ volt for carbon steel, $E_{corr}=+0.183$ volt for Monel, all potentials are with respect to a $Cu/CuF_2$ reference electrode). The connection to a more noble metal appears to drive the potential of carbon steel into an anodic protection (passivation) range. While any number of alloys are suitable for this purpose, the selected alloy preferably contains at least about 40 weight percent Ni and at least about 20 weight percent Cu, more preferably at least about 60 weight percent Ni and at least about 30 weight percent Cu, most preferably at least about 70 weight percent Ni with the substantial balance comprising Cu and other minor elements as necessary for tailoring the properties of the alloy as required.

But coupling carbon steel to a more noble alloy is also contrary to the well accepted convention in the industry that bonding a more noble metal to carbon steel (or any other less noble metal) will cause galvanic corrosion of the less noble metal. For example, if a carbon steel piping flange is bolted to a more noble flange material (e.g., austenitic stainless steel or a Monel brand Cu-Ni-Fe alloy) without the appropriate insulating gaskets and washers, those of ordinary skill in the art know that the carbon steel flange will corrode.

The anodic protection method of the invention further encompasses adding selected chemical species in the HF/sulfolane solution. For example, enriching the solution in certain ionic metal species decreases the corrosion rate of the carbon steel. Suitable ionic metal species include those of the Group IB and VIIIA metals, and Cu and Ag are preferred. One particularly preferred method of adding copper ions to the solution by adding $CuF_2$ to the solution of tetrahydrothiophene-1,1-dioxide and HF at dosages of from about 0.01 to about 10 weight percent, preferably from about 0.05 to about 5 weight percent, and more preferably from about 0.1 to about 0.5 weight percent.

The HF/tetrahydrothiophene-1,1-dioxide solution suitably contains from about 1 to about 99 weight percent HF, typically from about 10 to about 90 weight percent HF, and more typically from about 20 to about 60 weight percent HF. The solution preferably contains a small amount of water, preferably from about 1 to about 5 weight percent, more preferably from about 2 to about 3 weight percent.

The detailed mechanism of this anodic protection is not fully understood at this time. While not presented to limit the scope of the invention by a recitation of theory, it is speculated that the externally applied anodic potential, either through a potentiostat or the connection to a more noble metal, appears to encourage the formation of a protective film on the surface of the steel pipes and reactors to prevent severe corrosion attack.

Although the application of anodic protection has been proven successful in protecting stainless steels in sulfuric acid services, halogen ions such as chlorides and fluorides are known to be harmful to the protective films formed in that application. Acello, S. J., and Greene, N. D., Corrosion, Vol. 18 pp. 286t, 1962. In view of the well-accepted teachings that applying an anodic potential to carbon steel increases corrosion rate, the opposite behavior for carbon steel in an HF/sulfolane solution is indeed surprising. Furthermore, the method of the invention applies to carbon steel, a much cheaper material than stainless steel or Monel. Thus the method is particularly, cost effective.

EXAMPLES

The following Examples demonstrate the anodic protection method of the present invention.

EXAMPLE 1

Sulfolane Purification

Sulfolane was purified by the Jones Method by distillation below 100° C. (i) from solid sodium hydroxide, (ii) from sulfuric acid plus hydrogen peroxide, (iii) from solid sodium hydroxide, and (iv) twice from calcium hydride. Jones, J. G., Inorg, Chem., Vol. 5, pp. 1229, 1996.

EXAMPLE 2

Electrochemical Corrosion Test

Both "static" weight loss (Example 2A) and electrochemical measurements (Example 2B) were used to evaluate the effect of mitigation by anodic protection.

EXAMPLE 2A

Weight Loss

Weight loss corrosion test procedure: The corrosivities of the HF/sulfolane solutions were tested at:

Temperature, °F.: 75 and 85.

HF concentration, wt %: 50.

Stirring rate, rpm: 0 and 100.

HF/sulfolane loading was accomplished at liquid nitrogen temperature through a pressure regulator. 130 ml of each solution were placed into a Teflon coated stainless steel autoclave. A carbon steel weight-loss coupon (2.2 $cm^2$) was suspended in the liquid phase and the autoclave was maintained at the test temperature for up to 5 days by means of a temperature controller. In some experiments, Monel, an alloy of copper and nickel, was connected to carbon steel to observe the coupling effect. A liquid scrubber system was attached to the autoclave for the disposal of HF after each experiment. The weight losses of the coupons after the test were determined and the corresponding corrosion rates were calculated in terms of mpy.

EXAMPLE 2B

Electrochemical

Electrochemical corrosion test procedure: An electrochemical cell was built comprising a platinum counter electrode, a $Cu/CuF_2$ reference electrode and a carbon steel working electrode. All the potentials reported in this work are with respect to that reference electrode. The test conditions and loading procedure of the HF/sulfolane were the same as reported in part A. A potentiostat (Princeton Applied Research Model 273) was used to maintain the potentials between the working and reference electrodes. Corrosion rates were obtained from the polarization resistance measurements and AC impedance measurements. Corrosion rates were also checked by the weight loss measurements. For a discussion of polarization resistance measurement techniques, see Stern, M., and Geary, A. L., J. Electrochem. Soc., Vol. 104, pp. 56–63, 1957 and Lorenz, W. J., and Mansfeld, F., Corros, Sci., Vol. 21, pp. 647–674, 1981. For a discussion of weight loss measurements in relation to polarization resistance measurement techniques, see the Mansfeld article, cited above.

EXAMPLES 2A and 2B

Corrosion test results

The test results of carbon steel are shown in Table 1. The results show that:

Pure HF or pure sulfolane is not corrosive.

HF/sulfolane is very corrosive.

Anodic protection reduces the corrosion rate by two order of magnitude, from 806 mpy to 8.2 mpy.

The coupling of carbon steel and Monel alloy also decreases the corrosion rate to 6.0 mpy.

TABLE 1

Corrosion Results
Temperature, °F.: 85
Stirring Rate, rpm: 0
HF/sulfolane ratio: 1/1

| Run No. | | Test time, days mpy | Corrosion rate |
|---|---|---|---|
| | Example 2A | | |
| 1. | Sulfolane | 4 | 0.1 |
| 2. | HF | 5 | 0.3 |
| 3. | HF/sulfolane | 3 | 996 |
| | Example 2B | | |
| 4. | HF/sulfolane, at $E_{corr}$* | — | 806 |
| 5. | HF/sulfolane, at E = +0.3 volt* | — | 8.2 |
| 6. | HF/sulfolane, carbon steel connected to Monel | 34 | 6.0 |
| 7. | HF/sulfolane with 0.08 weight percent $CuF_2$ | 5 | 18.0 |

Runs 3–7 contained 2 weight percent water.

EXAMPLE 3

Polarization Scan

After 22 hours of free corrosion, a polarization scan was applied to the carbon steel working electrode. As shown in the FIGURE, the scan started at the cathodic potential (E = −300 mV) and ended at the anodic potential (E = +420 mV) with a scan rate of 0.5 mV/sec. The current which resulted from the externally applied potential can be expressed as $$I = I_a - I_c \text{ in the anodic potential range}$$

$$I = I_c - I_a \text{ in the cathodic potential range} \quad \{1\}$$

with $$I_a = I_{corr} \exp\{+(E - E_{corr})/B_a\} \text{ and}$$

$$I_c = I_{corr} \exp\{-(E - E_{corr})/B_c\} \quad \{2\}$$

where I is the net current, $I_a$ and $I_c$ are the anodic and cathodic branch currents, respectively, $I_{corr}$ is the equilibrium current, E is the potential, $E_{corr}$ is the free corrosion potential, $B_a$ and $B_c$ are the anodic and cathodic Tafel slopes, respectively. From Equations {1} and {2}, if the system remains unpolarized, then $E = E_{corr}$ and the net current I is zero. However, the anodic current $I_a$, which is the metal dissolution or oxidation current, is not zero, but equals $I_{corr}$. When the system is at its free corrosion potential, the corrosion rate then is calculated from $I_{corr}$. An anodic polarization ($E = E_{corr} > 0$) will increase $I_a$ and decrease $I_c$, thus the net current will also be increased as the potential increases. This can be seen in Region I as marked in the FIGURE. In this region, the corrosion rate of the metal is increased, as $I_a$ now is larger than $I_{corr}$. However, as the anodic polarization continues, a sudden drop in current occurs at E = 80 mV. When E is larger than about +150 mV, the metal is in Region II, i.e., the passive region. The current in the passive region is almost constant, even though the potential is still increasing. Thus the metal behaves as if it is protected against the external corrosive environment, and it is believed that this behavior is attributable to the formation of a compact protective film.

Changes and modifications in the specifically described embodiments can be carried out without departing from the scope of the invention which is intended to be limited only by the scope of the appended claims.

What is claimed is:

1. A method for inhibiting corrosion of a carbon steel structure in contact with a solution containing hydrofluoric acid, tetrahydrothiophene-1,1-dioxide, and from about 1 to about 5 weight percent water, comprising raising the electrical potential of said carbon steel structure by electrically connecting said carbon steel structure with a cathode which is in contact with said solution such that the electrical potential of said carbon steel structure is positive with respect to said solution containing hydrofluoric acid, tetrahydrothiophene-1,1-dioxide, and water.

2. The method of claim 1 further comprising raising the electrical potential of said structure by applying an externally generated anodic potential to said carbon steel.

3. A method for inhibiting corrosion of carbon steel in contact with a solution containing hydrofluoric acid, tetrahydrothiophene-1,1-dioxide, and from about 1 to about 5 weight percent water, comprising raising the electrical potential of said carbon steel by electrically connecting said carbon steel with a cathode which is in contact with said solution such that the electrical potential of said carbon steel is positive with respect to said solution containing hydrofluoric acid, tetrahydrothiophene-1,1-dioxide, and water.

4. The method of claim 3 wherein said raising of the electrical potential is effected by coupling said carbon steel to a more noble metal.

5. The method of claim 3 further comprising providing a corrosion inhibiting amount of an ionic metal species in said solution comprising hydrofluoric acid, tetrahydrothiophene-1,1-dioxide, and water, said ionic metal species being at least one selected from the group consisting of the Group IB and Group VIIIA metals.

6. The method of claim 5 wherein said ionic metal species is selected from the group consisting of copper and silver.

7. The method of claim 6 wherein said ionic metal species is copper.

8. The method of claim 7 wherein said copper is in the form of $CuF_2$.

9. A method for inhibiting corrosion of carbon steel in contact with a solution of hydrofluoric acid, tetrahydrothiophene-1,1-dioxide, and from about 1 to about 5 weight percent water comprising applying an anodic potential to said carbon steel from a cathode contacting said solution, wherein said anodic potential is positive with respect to said solution containing hydrofluoric acid, tetrahydrothiophene-1,1-dioxide, and water.

10. The method of claim 9 wherein said anodic potential applied to said carbon steel structure is at least about +0.1 volts with respect to said solution.

11. The method of claim 10 wherein said anodic potential applied to said carbon steel structure is at least about +0.3 volts with respect to said solution.

12. A method for inhibiting corrosion of carbon steel in contact with a solution of hydrofluoric acid, tetrahydrothiophene-1,1-dioxide, and from about 1 to about 5 weight percent water comprising providing a metal which is more noble than said carbon steel in contact with said solution and electrically connecting said carbon steel to said more noble metal.

13. A method for inhibiting corrosion of carbon steel in contact with a solution of hydrofluoric acid, tetrahydrothiophene-1,1-dioxide, and from about 1 to about 5 weight percent water comprising electrically coupling said carbon steel to an alloy of nickel and copper containing at least about 40 weight percent nickel and at least about 20 weight percent copper.

14. The method of claim 13 wherein said alloy contains at least about 60 weight percent nickel and at least about 30 weight percent copper.

15. The method of claim 13 wherein said alloy contains at least about 70 weight percent nickel.

* * * * *